US005356275A

United States Patent [19]

Brenner et al.

[11] Patent Number: 5,356,275

[45] Date of Patent: Oct. 18, 1994

[54] DEVICE FOR SUPPLYING A MULTI-STAGE DRY-RUNNING VACUUM PUMP WITH INERT GAS

[75] Inventors: Lothar Brenner, Bad Münstereifel Eichers cheid; Rudolf Bahnen, Roetgen, both of Fed. Rep. of Germany

[73] Assignee: Leybold Aktiengesellschaft, Hanau, Fed. Rep. of Germany

[21] Appl. No.: 108,675

[22] PCT Filed: Feb. 21, 1992

[86] PCT No.: PCT/EP92/00367

§ 371 Date: Sep. 1, 1993

§ 102(e) Date: Sep. 1, 1993

[30] Foreign Application Priority Data

Mar. 4, 1991 [EP] European Pat. Off. ..... 91103238

[51] Int. Cl.[5] ..... F01C 1/30

[52] U.S. Cl. ..... 418/9; 418/15; 137/597

[58] Field of Search ..... 418/5, 9, 10, 15; 137/597

[56] References Cited

U.S. PATENT DOCUMENTS

| | | | |
|---|---|---|---|
| 2,839,240 | 6/1958 | Bechtold | 418/9 |
| 3,512,553 | 5/1970 | Legris | 137/597 |
| 4,984,974 | 1/1991 | Naya et al. | 418/87 |
| 4,995,794 | 2/1991 | Wycliffe | 417/431 |
| 5,046,934 | 9/1991 | Berges | 418/97 |
| 5,049,050 | 9/1991 | Berges et al. | 418/9 |
| 5,082,427 | 1/1992 | Fujiwara et al. | 418/15 |
| 5,277,224 | 1/1994 | Hutton et al. | 137/597 |

*Primary Examiner*—Richard A. Bertsch
*Assistant Examiner*—Charles G. Freay
*Attorney, Agent, or Firm*—Felfe & Lynch

[57] ABSTRACT

The invention relates to a system for supplying inert gas to a multi-stage, dry-running vacuum pump (1) with systems for distributing the inert gas to the pump stages. To be able to monitor the flow of the inert gas and/or influence the rate of flow, a modularly constructed apparatus (36) with inert gas inlet, inert gas outlets and inert gas conduits is proposed, which is equipped with monitoring components.

12 Claims, 2 Drawing Sheets

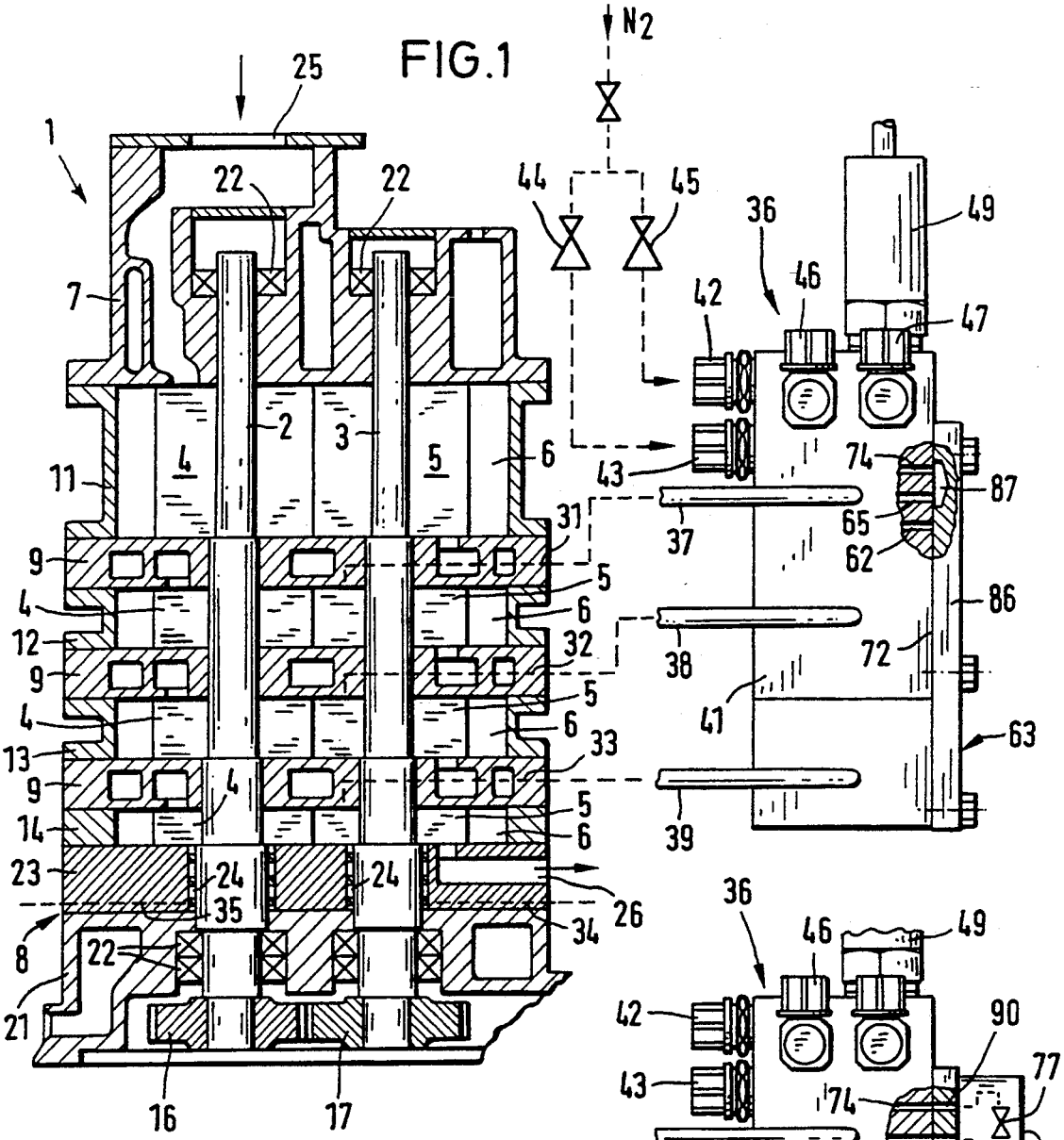
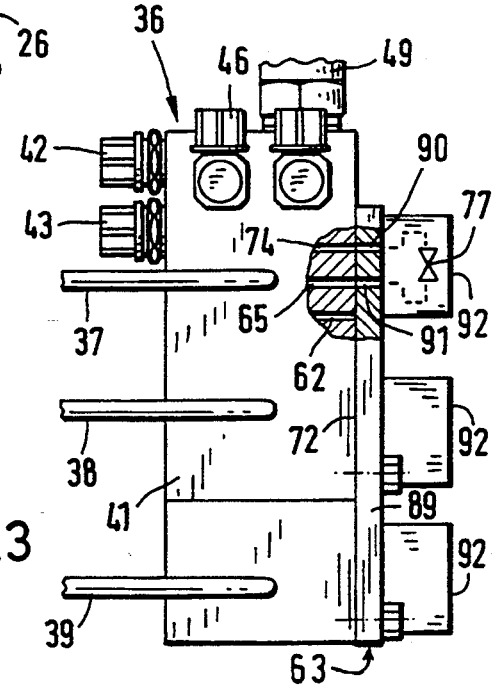
FIG.3

DEVICE FOR SUPPLYING A MULTI-STAGE DRY-RUNNING VACUUM PUMP WITH INERT GAS

BACKGROUND OF THE INVENTION

The invention relates to a system for supplying inert gas to a multi-stage dry-running vacuum pump with systems for distributing the inert gas to the stages of the pump.

"Dry-running" vacuum pumps are pumps whose chambers contain no lubricant and/or sealing material. Typical pumps of this kind are multi-stage pumps and have rotary pistons of the claw type (Northey profile). Their advantage lies in the fact that they can produce vacuums completely free of hydrocarbons, so that they are used especially for the evacuation of vacuum chambers in which semiconductor processes (etching, coating or other vacuum treatment or manufacturing processes) are performed.

EP-A 365,695 (to which U.S. Pat. No. 5,046,934 corresponds) discloses a multi-stage dry-running vacuum pump of the kind herein concerned. It is provided with an inert gas supply which consists of a nitrogen source, conduit systems leading into the pump chambers, and a valve. In this previously known pump it cannot be determined whether the inert gas supply is functioning properly while the pump is operating. The object of the present invention is therefore to create a system of the kind referred to above, which can be checked during operation. The feeding of inert gas to the pump is intended, among other purposes, to prevent solid particles entering the pump or forming in the pump while the gases are being compressed from depositing themselves on the rotor or on the walls of the pumping chambers. Depending on the nature of the semiconductor process the inert gas requirement will differ not only in regard to the amount needed but also in regard to the point, i.e., the stage, at which the inert gas is needed. It must also be considered that the feeding of inert gas while the pump is running adversely affects the pump's output.

The present invention is therefore addressed to the additional task of creating a system of the kind referred to above by means of which not only can the inert gas feed be monitored, but also the nature of its distribution and its rates of flow can be influenced.

SUMMARY OF THE INVENTION

Due to the independence of the inert gas supply and to its modular construction, it is possible in a simple manner to provide not only for the distribution of the nitrogen supply but also for many different control functions. The most widely different parameters, for example the pressure, the rate of flow to the individual stages, etc., can be controlled in relation to the process. By the replacement or rotation of components it becomes possible to make changes in the control criteria, the rates of flow etc., for the purpose of adaptation to different processes.

BRIEF DESCRIPTION OF THE DRAWINGS

FIG. 1 is a schematic section through a four-stage vacuum pump showing the inert gas source, partially cut away.

FIG. 3 shows an inert gas supply system differing from that in FIG. 1.

DETAILED DESCRIPTION OF THE PREFERRED EMBODIMENTS

Figure 2:
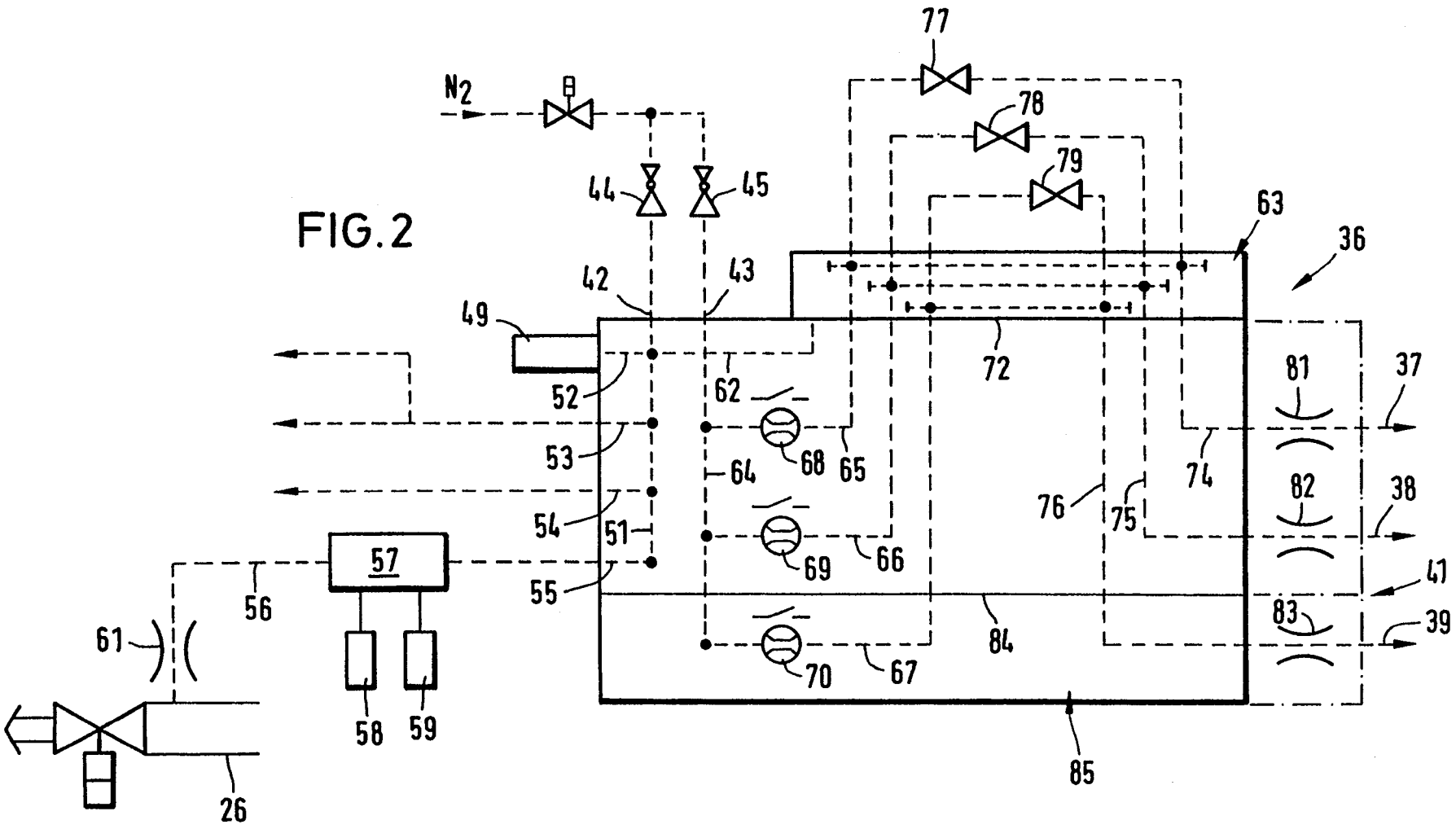
FIG. 2 shows an embodiment of the connection of the tubing in the system according to the invention.

The embodiment represented in FIG. 1 is a four-stage vacuum pump 1 with two shafts 2 and 3 plus four rotor pairs 4 and 5. The rotary pistons are of the claw type and rotate in the pump chambers 6. The latter are formed by the side plates 7 and 8, the middle plates 9 and 10 and the housing rings 11 to 14.

Below the bottom side plate 8 are the shafts 2 and 3 with gears 16 and 17 of equal diameter, which serve for the synchronization of the movements of the rotor pairs 4 and 5. Additional driving means (motor, drive clutch etc. ) are not shown.

The bottom bearing plate 8 is of bipartite construction. It includes the lower plate 21 in which, as also in the upper bearing plate 7, the shafts 2 and 3 are supported on rolling bearings 22. Between the shafts 2 and 3 and the upper plate 23 labyrinth seals 24 are provided.

The inlet of the pump in the upper bearing plate 7 is marked 25, and the discharge of the pump in plate 23 is marked 26.

To be able to feed inert gas to the pump chambers 4 and additional points in the vacuum pump 1, for example to the labyrinth seals 24, bores 31 to 35 are provided in the corresponding plates 9 and 23, and are connected by conduits to the supply system 36 according to the invention. Only conduits 37 to 39 are shown, which are connected to the bores 31 to 33 and through which inert gas is fed to the pump chambers 4.

The supply system according to the invention is configured as a metal block 41. It has two inlets 42 and 43 to which inert gas is fed through pressure reducing valves 44 and 45. Inside of the block 41 are bores not shown in detail, by means of which the inert gas distribution is achieved. The bores lead back out and are connected by inert gas outlets to the conduits 37, 38 and 39, for example. Additional outlets 46, 47 are marked 46 and 47. One of these outlets is connected, for example, with conduits leading to bores 34 and 35 and serve to supply the labyrinth seals 24 with nitrogen. The other outlet 47 can be adjoined, for example, by a conduit leading to the inlet 25 of the pump, so that the inlet connection can be flooded with inert gas. This outlet or an additional outlet can, however, also be used for supplying a pressure monitoring system situated at the discharge of the pump. Lastly, outward leading bores can be connected to measuring or monitoring systems which are carried by the metal block 41. A pressure monitor 49 is represented as an example.

FIG. 2 shows in a schematic manner an embodiment of the inert gas supply system 36 in accordance with the invention. Inert gas is fed to the system 36 through the two inlets 42 and 43 at different pressures, for example 1.5 bar and 3 bar. Bore 51 is connected to the inlet 42. From this bore 51 a plurality of branch bores 52 to 55 lead outward and form inert gas outlets which are in communication with conduits leading to the labyrinth seals 24, to the inlet of pump 25 or to the outlet of pump 26.

Bore 55 is connected to conduit 56 leading to the discharge 26 of the pump. In this conduit is a chamber 57 to which two pressure monitors 58 and 59 are connected. By means of these pressure monitors 58 and 59 a specific pressure range at the discharge of pump 36 is monitored. To prevent the pressure monitors 58 and 59 from being attacked by the often aggressive discharge gases, a constant stream of inert gas is maintained through conduit 56 toward the outlet 26. Between the outlet 26 and the chamber 57 there is also the throttle 61 which damps the pressure fluctuations occurring in the outlet 26.

Bore 51 is joined by still another bore 62 which leads outward and is closed by a removable component 63 which will be described in detail further below. By means of this bore 62 and the pressure monitor 49 it is possible to check component 63 for correct installation. As long as component 63 is not in place, the desired inert gas pressure cannot build up in bore 51, which is registered by the pressure monitor 49.

The inert gas connection 43 is connected to bore 64. Through bores 65, 66 and 67 branching therefrom, with the pressure monitors 68, 69 and 70 integrated therein, the second, third and fourth stages of the vacuum pump are to be supplied with inert gas. Bores 65, 66 and 67 are not directly connected to conduits 37, 38 and 39. They open in a lateral surface 72 of the metal block, with which the removable component 63 is associated. The removable component 63 can be configured such that it closes the mouths of bores 65, 66 and 67. In this case the inert gas supply to the pump stages is interrupted.

The removable component can furthermore be so configured that it connects the mouths of conduits 65, 66 and 67 with the bores 74, 75 and 76, which in turn are connected to conduits 37, 38 and 39. In an additional embodiment, the removable component 63 can be configured such that the connection of bores 65, 66 and 67 to bores 74, 75 and 76 is made via valves 77, 78 and 79 which are provided on the removable component 63. In this embodiment it is possible to interrupt or shut off the inert gas feed to individual pump stages.

The solid lines show which components or conduits are contained in the inert gas supply system 36 and in the metal block 41. In addition, throttles 81, 82, 83, arranged in the broken lines, can be situated in the block 41. These serve to establish the amount of gas fed to the pump stages, and also for increasing the gas velocity.

The solid line 84 indicates that the block 41 is divisible. The bottom section 85 is thus interchangeable with the pressure monitor 70. Thus it is possible, merely by replacing a part of the supply system according to the invention, to vary the amount of gas to be fed to the stage in question, including monitoring adapted thereto.

In FIG. 1 the removable component 63 adjacent the side 72 is configured as a plate 86, which is flat on the outside and has on the inside recesses 87. The location of the recesses 87 is selected such that it connects together conduits opening into the lateral surface 72, for example conduits 65 and 74. If the plate 86 is turned around, then all of the ports are closed.

The location of the port of conduit 62 is selected so that it is always closed by the plate 86, regardless of which side of the plate 86 lies against the side face 72. The already described check for the correct mounting of plate 86 is thereby assured.

FIG. 3 shows that a plate 89 with bores 90 and 91 is mounted on the side face 72. Via these bores conduits opening into the side face 72 are in communication with valves; represented again are the conduits 74 and 65 as well as the valve 77. The housings 92 of the valves are fastened on the outer side of plate 89.

With the system described, the operation of a dry-running vacuum pump can be adapted to different processes and supervised. This can be done automatically if a control unit, not shown, is present. The values registered by the monitoring and measuring components are fed to the control unit and compared with given set values.

We claim:

1. Apparatus for supplying inert gas to a dry running vacuum pump having an inlet, an outlet, a shaft, multiple stages, and shaft seals, said apparatus comprising a block having inert gas inlet means, inert gas outlet means, internal inlet conduit means connecting said inlet means to a surface of said block, and internal outlet conduit means connecting said outlet means to said surface of said block, and a removable component fixed to said surface of said block, said removable component connecting said internal inlet conduit means to said internal outlet conduit means.

2. Apparatus as in claim 1 wherein said inert gas inlet means comprises a first inert gas connection, said internal inlet conduit means comprising a plurality of inlet branch conduits connecting said first inert gas connection inlet to said surface, each said inlet branch conduit communicating with a respective pump stage, said apparatus further comprising inert gas monitoring means in each of said inlet branch conduits.

3. Apparatus as in claim 2 wherein said inert gas inlet means further comprises a second inert gas connection, said apparatus further comprising a plurality of auxiliary branch conduits in said block, said auxiliary branch conduits connecting said second inert gas connection to said shaft seals and at least one of said pump inlet and said pump outlet.

4. Apparatus as in claim 3 further comprising a pressure monitor mounted on said block and communicating with said second inert gas connection.

5. Apparatus as in claim 1 wherein said removable component is a plate having recess means connecting said inlet conduit means directly to said outlet conduit means.

6. Apparatus as in claim 1 wherein said removable component comprises a plate having bores therethrough and valves mounted on said plate, said valves communicating with said inlet conduit means and said outlet conduit means via said bores.

7. Apparatus as in claim 3 wherein one of said auxiliary branch conduits has a mouth on said surface of said block, said removable component closing said mouth when fixed to said surface.

8. Apparatus as in claim 3 wherein one of said auxiliary branch conduits is connected to said pump outlet and has pressure monitoring means disposed therein.

9. Apparatus as in claim 8 wherein said pressure monitoring means comprises a chamber to which two pressure monitors are connected.

10. Apparatus as in claim 9 further comprising a throttle in said one of said auxiliary branch conduits between said chamber and said pump outlet.

11. Apparatus as in claim 1 wherein said internal outlet conduit means comprises a plurality of outlet branch conduits, each said outlet branch conduit communicating with a respective pump stage.

12. Apparatus as in claim 11 wherein said apparatus further comprises a gas throttle in each outlet branch conduit.

* * * * *